United States Patent [19]

Glassman et al.

[11] 4,141,758

[45] Feb. 27, 1979

[54] COMPOSITIONS AND PROCESSES FOR PRODUCING CHROMIUM CONVERSION COATINGS ON SURFACES OF ZINC/IRON ALLOY

[75] Inventors: Wayne C. Glassman, Willowdale; Sydney H. Melbourne, Grimsby; Mary S. Morson, Stoney Creek; Urmas Soomet, Hamilton, all of Canada

[73] Assignee: Dominion Foundries and Steel, Limited, Hamilton, Canada

[21] Appl. No.: 793,376

[22] Filed: May 3, 1977

[30] Foreign Application Priority Data

Jan. 14, 1977 [CA] Canada ..... 269791

[51] Int. Cl.[2] ..... C23F 7/26

[52] U.S. Cl. ..... 148/6.2

[58] Field of Search ..... 148/6.2

[56] References Cited

U.S. PATENT DOCUMENTS

| | | | |
|---|---|---|---|
| 2,786,002 | 3/1957 | Ambler et al. | 148/6.2 |
| 3,857,739 | 12/1974 | Prust et al. | 148/6.2 |

*Primary Examiner*—Ralph S. Kendall

*Attorney, Agent, or Firm*—Hirons & Rogers

[57] ABSTRACT

In a process for producing a chromium protective coating on a zinc/iron alloy surface the surface has applied thereto an aqueous composition including chromium, perchlorate and fluoride ions with the chromium ion being the only metal ion present before application to the surface.

11 Claims, No Drawings

COMPOSITIONS AND PROCESSES FOR PRODUCING CHROMIUM CONVERSION COATINGS ON SURFACES OF ZINC/IRON ALLOY

FIELD OF THE INVENTION

This invention is concerned with improvements in or relating to compositions and processes for producing chromium conversion coatings on surfaces of zinc/iron alloy.

REVIEW OF THE PRIOR ART

A continuing problem arises in the field of applying protective coatings on zinc/iron alloy surfaces.

One method of forming such an alloy surface employed in commercial practise is by passing a steel strip or article through a molten zinc bath so as to apply a liquid zinc coating to the surface, and then mechanically wiping as much as possible of the zinc off the surface, so that only the small amount that has alloyed with the iron remains. In another process the zinc-coated strip is annealed until the zinc has been converted to the alloy.

The alloy protective coating itself may corrode in wet or humid conditions to give successively a black, white and then reddish deposit known as "storage stain". It is common therefore to apply a thin protective coating to the surface which usually consists of a chromium compound or compounds and is known as a "conversion" coating.

The conversion coating usually is formed by applying a suitable aqueous solution containing chromium to the surface, the solution reacting with the surface to form a thin gel-like film of complex chromates. The film is substantially non-porous to moisture, and also is non-crystalline, so that is provides a good paint bond without absorption of the paint onto the surface. Examples of processes from producing such a coating are given in U.S. Pat. No. 3,457,124 issued July 22, 1969 to Cowles Chemical Company, the solution including specified amounts selected from sodium diachromate, chromic acid, sulfamic acid, ammonium sulphate, boric acid, sodium silicoflouride and nitric acid.

There has been disclosed in U.S. Pat. No. 3,857,739, issued Dec. 13, 1974, assigned to the present assignee, a composition for producing a chromate protective coating on zinc or cadmium, the composition having a pH less than 1.5 and consisting of demineralized water, a source of chromium ion, the chromium ion being the only metallic ion present, the chromium ion being present in the amount of 5–15 grams per liter, a source of perchlorate ion, the perchlorate ion being present in the amount corresponding to from 0.3 to 0.5 ml of 60 percent perchloric acid per liter, and a source of fluoride ion, the fluoride ion being present in the amount corresponding to from 0.1 to 0.25 ml of 48 percent hydrofluoric acid per liter. There is also disclosed and claimed in that application a process for producing a conversion coating on a metal surface consisting of zinc or cadmium, comprising applying to the surface such a composition for a period of from 1 to 10 seconds at a temperature of from 125° F. to 200° F. It is mentioned in that specification that the composition and process are applicable to zinc/iron alloy coatings, but we have discovered unexpectedly that much superior results can be obtained for zinc/iron alloys by the composition and process of the present invention.

SUMMARY OF THE INVENTION

It is therefore the object of the present invention to provide a new composition for use in production of a protective coating on zinc/iron alloy surfaces, and a new process making use of such a composition.

In accordance with the present invention there is provided a composition for producing a chromate protective coating on zinc/iron alloy surfaces, the composition having a pH less than 1.20 and consisting of demineralized water, a source of chromium ion, the chromium ion being present in the amount of at least 20 grams per liter and not more than 36.4 grams per liter, a source of perchlorate ion, the perchlorate ion being present in the amount of from 0.4 to 1.2 grams per liter, and a source of fluoride ion, the fluoride ion being present in the amount of from 0.1 to 0.35 grams per liter, the chromium ion being the only metallic ion present therein.

The pH of the solution may be in the range 1.20 to 0.80, and preferably is in the range 1.0 to 0.9. The chromium ion may be present in the amount of not less than 20 and not more than 36.4 grams per liter, corresponding to the addition of 38.5 to 70.0 grams per liter anhydrous chromium trioxide to the solution, and preferably is present in the amount of 20 to 24 grams of ion per liter. The perchlorate ion may be present in the amount of 0.4 to 1.2 grams per liter, corresponding to the addition of 0.41 to 1.22 ml of 60% perchloric acid to each liter of solution, and preferably is present in the amount of 0.5 to 1.0 grams of ion per liter. The fluoride ion may be present in the amount of 0.1 to 0.35 grams per liter, corresponding to the addition of about 0.19 to 0.65 ml per liter of 48% hydrofluoric acid to the solution, and preferably is present in the amount of 0.12 to 0.25 grams per liter.

A process in accordance with the present invention includes applying a composition as specified in the preceding two paragraphs to a zinc/iron alloy surface for a period of from 1 to 10 seconds at a temperature of from 150° F. to 195° F. (65.5° C. to 90.5° C.).

For a description of apparatus suitable for carrying out the present invention, reference may be made to the abovementioned prior U.S. Pat. No. 3,857,739, the disclosure of which is incorporated herein by reference.

As explained above in the brief discussion of the prior art numerous attempts have been made in the past to apply to a zinc or cadmium or zinc/iron alloy surface a chromium "conversion" or passivation film to provide protection against storage stain. The exact composition of these films is not known, beyond that fact that they are complex chromate compounds incorporating metal ions of the surface to which they are applied. Spectrophotometric analysis shows that the chromium is present in both a water soluble hexavalent form and an insoluble trivalent form.

It is believed at the present time that the essential constituents of the aqueous coating composition of the present invention are a source of chromium ion, a source of perchlorate ion, and a source of fluoride ion, the chromium ion being the only metallic ion present therein. For the purposes of this definition ammonium and like complex ions (e.g. $H^+$ is not a complex ion) that act as metallic ions are regarded as metallic ions. The pH value of the solution is made less than 1.20 and preferably is in the range 0.9 to 1.0, with a preferred minimum of 0.8.

The chromium ion is supplied to the solution most conveniently in the form of anhydrous chromium trioxide, in which the chromium is in hexavalent form. This compound can constitute a convenient medium for specifying the required concentration of the chromium in the solution, which should be present as ion in the amount of 15.6 to 36.4 grams per liter, preferably 20 to 24 grams per liter. The corresponding quantities of the trioxide to be added are 30.0 to 70.0 grams per liter, preferably 38.5 to 46.2 grams per liter. The calculation of any other suitable material added to the solution will be apparent to those skilled in the art.

The perchlorate is added in the form of 60% perchloric acid to provide the required amount of ion of 0.4 to 1.2 grams per liter, and for this concentration the solution should contain from 0.41 to 1.22 ml per liter of the said 60% perchloric acid; preferably the perchlorate ion is present in the amount of 0.5 to 1.0 grams per liter. The fluoride ion conveniently is added as 48% hydrofluoric acid to provide from 0.1 to 0.35 grams per liter of the fluoride ion, preferably 0.12 to 0.25 grams per liter, and this amount of ion requires the addition of about 0.19 to 0.65 ml per liter of the acid, preferably 0.22 to 0.46 ml per liter.

The usable operating temperature range for the solution is 150° F. (65.5° C.) to 195° F. (90.5° C.), while the preferred temperature range is 170° F. (76.5° C.) to 190° F. (88° C.). With the high reactivity the time of application is of the order of 1 to 10 seconds only, preferably not more than 5 seconds, and provision for rinsing as described in the above-mentioned patent should be made operative if the exposure time increases to above ten seconds. An excessive exposure time is indicated by brown discoloration and even etching of the surface.

The exact mechanism for the formation of the chromate film is not known to the applicants at this time, and accordingly the invention disclosed and claimed herein is not to be limited by any mechanism which is postulated at this time. The solution in contact with the surface generates hydrogen which is believed to reduce some of the hexavalent chromium to trivalent chromium some of which may then be oxidized by the perchlorate ion back to the hexavalent state until some balance is achieved of the relative concentrations in the solution. The balance of the trivalent chromium goes into film formation on the alloy surface. The trivalent chromium is believed more effective than the hexavalent form in combining with the fluoride ion, with which it complexes readily during film formation.

The films produced by the application of the invention are found to be unexpectedly much more protective than those of known prior methods. One test known as the humidity cabinet test involves the use of a Cleveland Condensing Test Cabinet having its interior maintained at 100° F. (37.7° C.) wherein strips of the iron-zinc alloy coated steel are suspended above a water bath, the side exposed to the bath being at the said temperature of 100° F. (37.7° C.), while the other side is at the ambient temperature, usually about 70° F. (21° C.). The humidity of the cabinet interior is 100% and the water that condenses on the inner surface trickles back into the bath, giving the effect of a constant exposure to a rainy atmosphere. The strips are maintained under this condition until visual inspection shows that storage staining has begun with the formation of black corrosion spots on the surface of the iron-zinc alloy. The use of conventional dilute chromic acid solutions typically provides a conversion coating which protects the alloy for approximately 200 hours before such black spots form in this test. The solution described in the above-mentioned U.S. Pat. No 3,857,739, as applied to iron-zinc alloy coatings, will on average provide about 370 hours of protection before black storage stain spots form. Conversion coatings produced with the solution of the present invention provide an average of about 475 hours protection in this same test. To our knowledge, such a high degree of protection against storage strain formation is not provided by any other economical solution or treatment of which we are aware at present.

In another more severe test known as the Salt Fog test (A.S.T.M. No: B117-62) the test panels are placed in a fine mist of 5% salt solution at 100° F. After 64 hours of exposure to this salt fog, iron zinc alloy panels with no conversion coating show advanced corrosion (i.e. red rust) over their entire surface areas. Conversion coatings produced by the use of conventional dilute chromic acid solutions offer protection such that, on average, only 60% of the surface area of a test panel shows corrosion after 64 hours. The solution described in U.S. Pat. No. 3,857,739 will produce an improved conversion coating such that, on average, 50% of the surface area of a test panel is corroded after 64 hours. After the same 64 hour test, test panels treated with the solution of the present invention show on average corrosion stains over only 6% of their surface area.

It is known that a mere increase in thickness of the film does not necessarily increase the protection afforded thereby, and these improved results indicate that the films obtained are not only thicker, but also are more impervious to penetration by water vapour, etc. It is known that the hexavalent chromium is considerably more mobile in the film-forming complexes than the trivalent form, in addition to being more soluble, and does operate to provide a "sealing" mechanism whereby the mobile hexavalent ion migrates to potential "holes" in the film and reacts readily with the zinc to close such holes. However, it is the trivalant form complexed with the zinc and the fluorine that provides the essential protective film. Excess solution removed from the surface during the process is found to have the chromium predominantly in the hexavalent form because of its higher solubility and concentration.

We claim:

1. A composition for producing a chromate protective coating on zinc/iron alloy surfaces, the composition having a pH less than 1.20 and consisting of demineralised water, a source of chromium ion, the chromium ion being present in the amount of at least 20 grams per liter and not more than 36.4 grams per liter, a source of perchlorate ion, the perchlorate ion being present in the amount of from 0.4 to 1.2 grams per liter, and a source of fluoride ion, the fluoride ion being present in the amount of from 0.1 to 0.35 grams per liter, the chromium ion being the only metallic ion present therein.

2. A composition as claimed in claim 1, wherein the pH of the solution is in the range 1.20 to 0.80.

3. A composition as claimed in claim 2, wherein the pH of the solution is in the range of 1.0 to 0.9.

4. A composition as claimed in claim 1, wherein the chromium ion is present in the amount of not more than 24 grams per liter.

5. A composition as claimed in claim 1, wherein the chromium ion is present in the amount of not more than 24 grams per liter, and wherein the fluoride ion is present in the amount of 0.12 to 0.25 grams per liter.

6. A process for producing a conversion coating on a metal surface consisting of zinc/iron alloy, comprising applying to the surface for a period of from 1 to 10 seconds at a temperature of from 150° F. to 195° F. a composition having a pH less than 1.20 and consisting of demineralised water, a source of chromium ion, the chromium ion being present in the amount of at least 20 grams per liter and not more than 36.4 grams per liter, a source of perchlorate ion, the perchlorate ion being present in the amount of from 0.4 to 1.2 grams per liter and a source of fluoride ion, the fluoride ion being present in the amount of from 0.1 to 0.35 grams per liter, the chromium ion being the only metallic ion present therein.

7. A process as claimed in claim 6, wherein the composition is applied at a temperature of 170° to 190° F.

8. A process as claimed in claim 6, wherein the pH of the solution is in the range 1.20 to 0.80.

9. A process as claimed in claim 8 wherein the pH of the solution is in the range of 1.0 to 0.9.

10. A process as claimed in claim 6, wherein the chromium ion is present in the amount of not more than 24 grams per liter.

11. A process as claimed in claim 6, wherein the chromium ion is present in the amount of not more than 24 grams per liter, and wherein the fluoride ion is present in the amount of 0.12 to 0.25 grams per liter.

* * * * *